US010196861B2

(12) United States Patent
Pionetti et al.

(10) Patent No.: US 10,196,861 B2
(45) Date of Patent: Feb. 5, 2019

(54) METHOD FOR INSTALLATION AND IMPLEMENTATION OF A RIGID TUBE FROM A SHIP OR FLOATING SUPPORT

(71) Applicant: SAIPEM S.A., Montigny le Bretonneux (FR)

(72) Inventors: François Régis Pionetti, La Baleine (FR); Nicolas Chazot, Gif sur Yvette (FR); François Lirola, Courbevoie (FR); Cédric Bruguier, Paris (FR)

(73) Assignee: Saipem S.A., Montigny le Bretonneux (FR)

( * ) Notice: Subject to any disclaimer, the term of this patent is extended or adjusted under 35 U.S.C. 154(b) by 138 days.

(21) Appl. No.: 15/305,963

(22) PCT Filed: Apr. 20, 2015

(86) PCT No.: PCT/FR2015/051063
§ 371 (c)(1),
(2) Date: Oct. 21, 2016

(87) PCT Pub. No.: WO2015/162363
PCT Pub. Date: Oct. 29, 2015

(65) Prior Publication Data

US 2017/0044838 A1 Feb. 16, 2017

(30) Foreign Application Priority Data

Apr. 25, 2014 (FR) ..... 14 53762

(51) Int. Cl.
*E21B 17/01* (2006.01)
*E21B 19/22* (2006.01)
*E21B 19/09* (2006.01)

(52) U.S. Cl.
CPC ..... *E21B 17/017* (2013.01); *E21B 19/09* (2013.01); *E21B 19/22* (2013.01)

(58) Field of Classification Search
CPC ..... E21B 17/017; E21B 19/09; E21B 19/22
See application file for complete search history.

(56) References Cited

U.S. PATENT DOCUMENTS 5,558,467 A * 9/1996 Horton ..... B63B 35/4413 166/345
6,176,646 B1 * 1/2001 Finn ..... E21B 17/012 166/350

(Continued)

FOREIGN PATENT DOCUMENTS

EP 2 436 873 4/2012
EP 2 503 093 9/2012

(Continued)

*Primary Examiner* — Benjamin F Fiorello
(74) *Attorney, Agent, or Firm* — Cozen O'Connor

(57) ABSTRACT

A method of installing and implementing a rigid tube (10) referred to as a "main" tube, wherein the following steps are performed: a) lowering an end of the main tube from a floating support or vessel (13) on the surface (14) to below sea level (14) to be connected to undersea equipment (16) that is immersed (17); and b) maintaining the main tube as immersed in this way for a given period of time. The said main tube (10) is caused to pass through a cylindrical orifice (4) of circular section in a stress limiter device, the orifice having a slippery internal coating (3) secured to a support structure (9) secured to the floating support or vessel, the service tube thus being suitable for sliding in contact against the slippery coating during steps a) and b).

15 Claims, 1 Drawing Sheet

(56) References Cited

U.S. PATENT DOCUMENTS

| | | | | |
|---|---|---|---|---|
| 8,210,775 | B2 * | 7/2012 | Clevelario | F16L 1/123 405/158 |
| 2002/0060077 | A1 * | 5/2002 | Biolley | E21B 17/015 166/350 |
| 2008/0044233 | A1 * | 2/2008 | O'Sullivan | E21B 17/017 405/158 |
| 2009/0299343 | A1 * | 12/2009 | Rogers | A61B 1/00078 606/1 |
| 2011/0155383 | A1 * | 6/2011 | Christiansen | E21B 17/015 166/345 |
| 2011/0178730 | A1 * | 7/2011 | Mangal | E21B 17/017 702/43 |
| 2011/0180265 | A1 * | 7/2011 | Shand | E21B 19/004 166/345 |
| 2012/0080115 | A1 * | 4/2012 | Lund | E21B 17/203 138/173 |
| 2012/0241037 | A1 * | 9/2012 | Lund | E21B 17/017 138/106 |
| 2014/0212221 | A1 * | 7/2014 | Routeau | E21B 43/0107 405/168.1 |

FOREIGN PATENT DOCUMENTS

| | | |
|---|---|---|
| FR | 2 871 511 | 12/2005 |
| FR | 2 952 118 | 5/2011 |
| WO | WO 2009/109745 | 9/2009 |
| WO | WO 2009/138610 | 11/2009 |
| WO | WO 2009/156722 | 12/2009 |
| WO | WO 2010/030160 | 3/2010 |
| WO | WO 2012/051335 | 4/2012 |

* cited by examiner

METHOD FOR INSTALLATION AND IMPLEMENTATION OF A RIGID TUBE FROM A SHIP OR FLOATING SUPPORT

PRIORITY CLAIM

This is a U.S. national stage of application No. PCT/FR2015/051063, filed on Apr. 20, 2015. Priority is claimed on French Application No. FR1453762, filed Apr. 25, 2014, the content of which is incorporated here by reference.

BACKGROUND OF THE INVENTION

The present invention relates to the field of installing and implementing rigid steel pipes under the sea from a floating support or vessel on the surface and going down to equipment that is immersed, preferably down to the sea bottom. Such rigid tubes may be so-called "service" tubes that are implemented for testing or maintaining said undersea equipment from the surface of the sea, or indeed pipes for transporting production or service fluids to such equipment, in particular undersea pipes for transporting petroleum or associated fluids, or wellheads or other pieces of equipment. Such rigid tubes are intended more particularly for testing such undersea equipment from the surface by conveying liquids or gases thereto at varying temperatures and pressures. In particular, the tests implemented consist in filling the production undersea pipe with a liquid in order to clean the line, e.g. treated sea water under pressure, and causing a scraper to pass therealong in order to clean it, for example. The undersea pipe may subsequently be dried by delivering a gas such as air thereto. The production pipe may also be subjected to an immersing method using mono-ethanol-glycol and/or nitrogen.

Service tubes are rigid tubes made of steel or metal or of any other material, in particular composite material, that are wound on a drum at the surface and then employed in immersion in the sea in order to be connected to equipment that is immersed or at the sea bottom, and then perform a said test or maintenance operation by sending down liquids or gases, and they are finally recovered from the vessel or floating support by winding. Such windable service tubes are also known as "coiled tubing" and may be unwound and rewound several times. In general, their top ends remain wound in part on the drum so such a tube is not completely unwound. Nevertheless, in certain circumstances, the top end of the tube may be completely unwound and secured at the surface.

In practice, such service tubes present diameters of relatively small size compared with the diameters of standard undersea oil production pipes, and in particular they may be steel service tubes with diameters of less than 10 inches ("), and more particularly in the range 1.5" to 6", and still more particularly in the range 1.75" to 4.5", more particularly 50 millimeters (mm) to 100 mm, for taking action at depths of more than 1000 meters (m) or indeed more than 2000 m.

On being wound, such rigid steel service tubes are subjected to deformation that is "plastic" in the mechanical meaning of the term, i.e. the stresses that are applied to the tube go beyond the elastic limit of the tube and it is thus permanently deformed. Thereafter, while the tube is being unwound, the tension that is applied in order to unwind it serves to straighten it out on leaving the drum, possibly in combination with a straightener. More particularly, rigid steel service tubes of the type in question present elastic limits in the range 335 megapascals (MPa) to 750 MPa.

Rigid service tubes of this type are described in the prior art, in particular in WO 2012/051335.

Because of successive unwinding and winding, and also because of movements of a service tube while it is being deployed and in operation, a service tube is subjected to high levels of localized stress at the point from which it is suspended at the surface. Thus, the rolling, pitching, and heaving of the floating support or vessel, and also the action of waves, wind, and/or currents on the service tubes and on the floating support or vessel give rise to high levels of bending at the point from which the tube is suspended and/or fastened to the floating support or vessel, with this being particularly severe when the length and thus the weight and also the pressure of the fluid conveyed in the service tube are all large.

In order to mitigate that problem, the practical solution that is presently used consists in unwinding additional length of tube on a regular basis, in particular lengths of a few meters, so as to shift the zone of the service tube on which the stress forces act. Nevertheless, that solution is applicable only to service tubes of small diameter, and in particular of diameter less than 50 mm, and for service tube operations of duration shorter than one day, suitable for use when taking action at depths limited to less than 1000 m. For periods that are longer, and for taking action at depths that are greater than 2000 m in particular, and also for tubes of diameters that are larger, the rigid tube becomes excessively fatigued and runs the risk of breaking. More particularly, at present, operations continue for a few hours and the rigid line can be unwound by a few meters after each operation in order to minimize the fatigue that occurs in the same zone of the rigid tube, whereas operations at great depth continue for more than one day or indeed more than one month, and the risk of the tube rupturing due to fatigue becomes very great, and in the event of the tube accidentally rupturing there can be consequences that are disastrous for the equipment, for personnel, and for equipment on the sea bottom.

That solution is therefore not applicable for use at great depths where the service tube continues to be used for weeks and where the diameters needed are greater than 50 mm.

Another problem that is encountered relates to connecting the termination of the rigid tube to test equipment or to equipment that is to be tested or operated. The rigid metal tube needs to present a connection element at its end, in particular an element of the automatic connector type, which equipment is of diameter that is greater than the diameter of the service tube in order to enable its end to be connected to a semi-rigid pipe or more usually to an intermediate flexible pipe. Unfortunately, it is not easy to assemble such a connection element to the tube once its end is immersed at the sea bottom. One presently-known solution consists in assembling said connection elements at the surface to the end of the service tube before deploying it to the sea bottom.

Bend stiffener type devices or bend restrictor type curvature limiters are known that are applied to the ends of flexible pipes, as described in EP 2 503 093, FR 2 952 118, and FR 2 871 511. Bend limiters or stiffeners for flexible pipes are generally made in the form of conical parts made out of synthetic materials, in particular polyurethane type elastomer material. Parts of this type that are made of steel are also known, and they are applied to the end of a rigid steel pipe of "riser" type in order to embed it in a part for providing a transition in second moment of area (or "inertia") of the type known as a "taper" joint or as an "adaptor" joint, as described in WO 2009/138610. Such parts extend the existing pipe, and as a general rule they are welded to the pipe or they are assembled thereto by means of a flange.

The conical shape provides a transition in second moment of area by progressively and continuously reducing in diameter starting from the point that suffers the greatest mechanical stress. Because such conical parts are secured of the end of the pipe, the forces to which said pipe end are subjected are transferred to the conical part and the increase in its section enables the overall stress to be spread out, thereby providing a smoother stiffness transition and thus a reduction in local stresses. The section of the conical part decreases progressively as a function of the decrease in said stress, with the stress being at its maximum at the point where the end of the pipe is connected or suspended.

Solutions of that type as applied to a tube as described above are inappropriate, given the need to allow the top end of the rigid tube to be wound out and wound in at its point of suspension at the surface.

SUMMARY OF THE INVENTION

The object of the present invention is to provide a solution to the above-described stress forces on rigid tubes deployed from the surface to a great depth, and more particularly to limit the dynamic fatigue in a said rigid tube that results from it being used in suspension from a floating support or vessel at the surface during long periods of operation, thereby increasing the fatigue lifetime of the rigid tube.

Another object is to facilitate the deployment of said rigid tube, in particular of service tubes, from the surface.

To do this, the present invention provides a method of implementing a rigid tube, referred to below as a "main" tube, preferably a main tube made of steel, from a floating support or vessel on the surface to below sea level, preferably in order to be connected to immersed undersea equipment preferably down to the sea bottom, wherein the following steps are performed:

a) lowering an end of said main tube from a floating support or vessel on the surface to below sea level in order to be connected to undersea equipment that is immersed, preferably at the sea bottom; and b) maintaining said main tube as immersed in this way for a given period of time;

the method being characterized in that said main tube is passed through a cylindrical orifice of circular section, of vertical axis (ZZ'), in a stress limiter device referred to as a sliding stiffener, said orifice referred to as a "first" orifice having a slippery internal coating in contact with said main tube, said sliding stiffener being secured to a support structure secured to said floating support or vessel and extending outside said floating support or vessel over the surface of the sea, a top portion of said main tube being held in suspension above said sliding stiffener, the main tube thus being suitable for sliding in contact against said slippery coating during steps a) and b).

More particularly, in step a), the following steps are performed:

a.1) unwinding said main tube wound on a winding support on said floating support or said vessel; and a.2) lowering said main tube below sea level, preferably to a said immersed underwater piece of equipment, by causing it to slide through said sliding stiffener.

It can be understood that said first orifice is of substantially the same diameter as said main tube with minimum mechanical clearance enabling it to be inserted in and to slide along said orifice, e.g. clearance in the range 1 mm to 5 mm as a function of the diameter and the length of the service tube. Although such clearance is necessary to be able to insert said main tube in the stiffener, it must be kept to a strict minimum in order to guarantee that said stiffener is effective.

It can be understood that the axial direction which is vertical or slightly inclined by less than 30°, more generally by less than 10°, of said cylindrical orifice of the stiffener extends in a direction perpendicular to the theoretically horizontal surface of the sea surface when the sea is flat and the floating support or vessel is stationary or slightly inclined by less than 30° relative to said perpendicular, more generally less than 10°.

It can also be understood that the main tube is caused to slide in order to be used at the sea bottom from the floating support or vessel, and also that the main tube continues to be capable of sliding in the stiffener while it is being used in operation when the floating support or vessel and said main tube are subjected to movements associated with swell, waves, sea currents, and/or wind.

The function of the sliding stiffener of the invention is to transfer to said support structure the bending forces to which said main tube in contact with the stiffener is subjected in the event of relative movements between the stiffener and said main tube, i.e. to transfer the bending moments to which said main tube is subjected as a result of its horizontal lateral movements and as a result of its bending, given that traction and compression forces, if any, are not taken up by the stiffener because of its slippery nature. The application of this stiffener is thus limited to taking up bending forces, as a "bend stiffener".

This anti-abrasive slippery coating with a minimum amount of clearance serves to avoid the service tube being damaged while it is being deployed and while it is in use, it being possible for its contact with its guide and suspension point at the surface to be subjected, in the absence of the slippery coating, to wear that is as harmful as the effect of a hacksaw on the tube as a result of multiple repeated sliding movements.

The stiffener method and device of the invention thus make it possible to deploy a said main tube through said stiffener from a floating support or vessel to a great depth, while minimizing the abrasion of said main tube as said tube moves up and down and by limiting the dynamic fatigue in said main tube resulting from its use in suspension from the floating support or vessel during long periods at sea, in practice the method and device of the present invention make it possible to multiply the fatigue lifetime of said main tube by a safety factor that is often greater than 10. This invention also makes it possible to enable said main tube to be used in rougher sea states, thereby limiting waiting for an acceptable weather window.

More particularly, the dimensions of the stiffener are defined so that the stress of said main tube does not exceed 50% to 80% of the elastic limit of the steel of the main tube.

In practice, and by way of illustration, for ordinary main tubes having diameters in the range 1.5" to 8" (i.e. not more than 100 mm), with an elastic limit in the range 350 MPa to 750 MPa, and immersed to a depth in the range 1000 m to 3000 m, the stiffener presents a length L1 in the range 1 m to 8 m and a maximum outside diameter D1 for its main portion in the range 100 mm to 200 mm for a half-angle at the apex of the cone lying in the range 0° to 5°.

Because the stiffener takes up bending forces only, it is dimensioned as a function of the maximum bending acceptable for the service tube and not as a function of acceptable tension and thus immersion depth.

Specifically, said main tube can expand also in the radial direction (as a result of the pressure and the temperature of the fluid conveyed), but this radial expansion can never exceed 0.2%, which is negligible, e.g. 0.2 mm for a diameter of 100 mm, i.e. less than the clearance. In addition, it should be observed that inserting the said main tube into the stiffener takes place at ambient temperature and without pressure and thus without expansion and with maximum clearance. Thereafter, any radial expansion in operation will tend to reduce the clearance and increase the quality of the force take-up function.

More particularly, said sliding stiffener comprises a solid rigid part preferably made of steel having a said cylindrical orifice referred to as a "first" orifice passing through its material along a vertical axis (ZZ'), said rigid part comprising a main portion presenting an outside surface of revolution about the axis of said first cylindrical orifice, preferably of diameter that decreases progressively and continuously going down said stiffener to the bottom end of said stiffener.

Thus, the increase in the section of the stiffener takes up the forces and stresses to which said main tube is subjected and transfers them to the stiffener at the most where the stress is the greatest at the top level, i.e. at the point of connection or contact between the stiffener and the support structure.

Still more particularly, said main portion of the rigid part constituting said stiffener presents an outside surface of frustoconical shape extending from and below a top portion of said rigid part defining a fastener flange around the top end of said first orifice.

In a preferred embodiment, said fastener flange forms a fastener plate fastened to or formed integrally with the top end of said main portion, said fastener plate resting on and being fastened to a horizontal platform of said support structure, said fastener plate extending on a plane surface on top of said platform of dimension (D2) that is greater than the greatest section (D1) of said main portion, preferably a said plane plate surface of circular circumference coaxial with the circumference of said first orifice, preferably a said plane plate surface of maximum dimension (D2) that is at least twice and preferably at least five times the maximum dimension of said greatest section (D1) of said main portion of the conical part.

When said fastener plate or flange is fastened to the top end of the main portion of the conical part, it is preferably fastened by welding or by bolting. When it is made integrally with the main portion, it may be made by molding and/or forging in the form of a single steel forged part or by being machined from a forged part, where appropriate.

The main tube, the stiffener, and the connection tube may be made of any other rigid material, such as composite materials.

The increase in dimension, and in particular the discontinuous increase in diameter at the fastener flange compared with the main portion of the stiffener makes it possible to increase the surface area over which the stress transferred to the platform of the support structure is spread, thereby locally reducing the stress on the platform as transferred from the top end of the stiffener, i.e. where the stress is at a maximum. Thus, in practice, said fastener plate may be of small thickness compared with the maximum thickness of the main portion of the rigid part and may be fastened to the platform by bolts, since stresses are greatly reduced.

It can indeed be understood that:

the main portion passes through said platform and extends from and below said fastener platform and then below said platform, its bottom end possibly being immersed under the surface of the sea; and the section of the main portion is a cross-section, i.e. a section in a plane perpendicular to its vertical longitudinal axial direction.

Still more particularly, said first orifice of said rigid stiffener part is covered on its surface in contact with said main tube in a slippery coating constituted by a low friction anti-abrasion material selected from a liquid material such as an oil, a viscous material such as a grease, and a solid material such as a coating in the form of a plastics film layer of the liner type, preferably made of a thermoplastic material of the polyethylene (PE), polypropylene (PP), polyamine (PA), or polyvinylidenefluoride (PVDF) type or of an elastomer, said plastics coating also preferably being coated on its surface in contact with said main tube (10) in a low friction anti-abrasion material selected from a liquid material such as an oil and a viscous material such as a grease.

More particularly, said main tube is coated in a low friction anti-abrasion material selected from a liquid material such as an oil and a viscous material such as a grease, the treatment for performing this coating preferably being performed after step a) and before inserting the main tube in said first orifice.

The type of thermoplastic for the liner is defined as a function of its utilization temperature. In most circumstances, high density polyethylene (PEHD) suffices, but above 60° C., it is preferable to use PP.

This anti-abrasive slippery coating with some limited amount of clearance makes it possible to avoid said main tube deteriorating while it is being deployed and while it is in use, with its contact with its guide and suspension point on the surface possibly being subjected to wear that is as harmful as a hacksaw acting on said tube in the absence of any slippery coating.

It should also be observed that the clearance between said main tube and the first orifice increases with increasing number of deployments of said main tube. The clearance should thus be reduced to the minimum. That is why introducing said tube into the stiffener advantageously requires grease in order to enable it to slide properly. A grease box into which said main tube penetrates and through which it slides is then positioned above the stiffener in order to provide a permanent source of lubricant during deployment and raising of said main tube. By construction, said tubes are tubes with smooth surfaces and without burrs, nevertheless, a trimming collar may also advantageously be mounted above the stiffener in order to eliminate or flatten microdefects that might damage the liner. For example, the collar might be a small cylindrical block with a sharp edge in one or two portions through which said main tube penetrates and slides. The collar may advantageously be combined with the grease box.

According to another advantageous particular characteristic, in order to perform step a), said main tube is passed through a device for tensioning and reducing residual curvature associated with winding, and then through a grease box and a trimming collar prior to being inserted into the stiffener, such that the outside surface of said tube is coated in grease before it slides in said first orifice.

It can be understood that this characteristic serves to improve the sliding properties of said main tube inside said first orifice.

More particularly, an undersea pipe and/or a wellbore at the sea bottom is verified and/or maintained by sending a liquid or a gas via said main tube having its bottom end connected to said undersea pipe and/or a wellbore at the sea bottom, preferably by means of a flexible or semi-rigid pipe.

In a preferred implementation, said stiffener is pre-fitted with a tube portion referred to as a connection tube that is fastened and/or suspended in reversible manner to said support structure and/or to said stiffener, said connection tube preferably being of the same diameter and more preferably of identical composition to said main tube, said connection tube being engaged in said first orifice and having a connection element at its bottom end beneath said stiffener, the connection element being connected or suitable for being connected to a piece of equipment, preferably a flexible or semi-rigid pipe, and prior to step a), the following steps are performed:

connecting the end of said main tube to the top end of said connection tube, preferably by welding and then abrading the weld bead;

separating said connection tube from said stiffener device; and beginning the descent by descending said connection tube.

More particularly, said connection tube includes a removable clamping collar around a portion of said connection tube projecting above said first orifice.

It can thus be understood that said connection tube is of substantially the same diameter as said main tube and is longer than said stiffener, more precisely longer than the length of said first orifice in order to enable its connections to be made above and below said stiffener. Said connection tube performs several functions:

it serves in particular to connect with the main tube by welding, the weld and in particular the connection, being made on said support structure above the surface of the sea in a zone that is dry and thus of easy access, and since this connection is made at the surface it can be repaired or redone at will by rewinding the main tube, it nevertheless being understood that since this connection and in particular this weld are to be found at the sea bottom when in operation they are not subjected to the elastic fatigue to which the main tube is subjected at its suspension point at the surface;

its bottom end is fitted with a connection element itself previously welded to the connection tube since it cannot pass through said first orifice of the stiffener element for reasons of size and tolerance; and said connection tube may subsequently be connected to undersea equipment for connection to the end of the main tube such as mooring sinkers or flexible or semi-rigid pipes or other pieces of equipment.

This implementation is particularly advantageous in that it facilitates connecting the end of said main tube to equipment for use underwater, in particular a flexible pipe that is to be connected to the end of said main pipe via said connection element pre-fitted to the bottom end of said connection tube.

More particularly, the top end of the connection tube that projects above the stiffener may be terminated by a weld chamfer.

The assembly comprising the stiffener and the connection tube can easily be handled and installed on said support structure on the floating support or the vessel prior to being assembled, in particular by welding, to the end of said main tube, said main tube can then be deployed while fitted with its terminal connection element of diameter that is greater than the diameter of said first orifice in the stiffener.

Otherwise, said connection element, which is of greater diameter than the first orifice and which cannot pass through it, needs to be mounted to the end of the service tube after the service tube has been deployed and slid through said first orifice, and that would complicate the procedure for using the main tube.

When the main tube is finally raised and rewound, its end including the stiffener and the connection tube may be cut off and said assembly of stiffener and connection tube can be stored ready for subsequent use.

Overall, the system of the present invention is easy to use. Its theoretical lifetime may be several years and in any event compatible with the lifetime of the main tube.

Thus, more particularly, a rigid steel main tube made of steel unwound from a floating support or a vessel at the surface down to the sea bottom passing through a said stiffener is maintained and stabilized after said descent and implementation for a period of at least 24 hours (h), preferably at least 1 month before raising it to the surface and/or without unwinding any additional length.

The present invention also provides an installation suitable for implementing a method of the invention and characterized in that it comprises a support structure secured to a floating support or vessel on the surface, the support structure having fastened thereto a stiffener comprising a solid rigid part having an outside surface of revolution of diameter that decreases progressively and continuously going up said stiffener to the bottom end of said stiffener, preferably made of steel, having an axial orifice referred to as a "first" orifice with a slippery internal coating suitable for enabling sliding of a main tube inserted into said first orifice in contact with said main tube.

More particularly, said first orifice of said rigid stiffener part is covered on its surface in contact with the main tube in a slippery coating constituted by a low friction anti-abrasion material selected from a liquid material such as an oil, a viscous material such as a grease, and a solid material such as a coating of a layer of plastics film of liner type, preferably made of a thermoplastic material of PE, PP, PA, or PVDF type, or of an elastomer.

Still more particularly, said stiffener is fitted with a tube portion referred to as a "connection" tube that is reversibly fastened to said stiffener, said connection tube having the same diameter as and preferably identical composition to said main tube, said connection tube being engaged in said first orifice and having at its bottom end, below said stiffener, a connection element that is connected to or suitable for being connected a piece of equipment, preferably a flexible pipe.

Still more particularly, said connection tube includes a removable clamping collar around a portion of said connection tube projecting above said first orifice.

BRIEF DESCRIPTION OF THE DRAWINGS

Other characteristics and advantages of the present invention appear in the light of the following detailed description made with reference to the figures, in which:

FIGS. 1A to 1C are a side view (FIG. 1A) and axial vertical section views (FIGS. 1B and 1C) of a sliding stiffener 1 of the present invention pre-fitted with a connection tube 5 (FIG. 1B) and without a connection tube (FIG. 1C);

FIG. 2 is a view of a bottom-to-surface connection installation fitted with a stiffener device of the present invention referred to below as a sliding stiffener;

FIG. 3 shows the portion of the installation on board the vessel; and

FIG. 3A shows a detail at the junction between the sliding stiffener 1 and a support structure or beam 9 of the vessel.

DETAILED DESCRIPTION OF THE PRESENTLY PREFERRED EMBODIMENTS

Figure 1A:
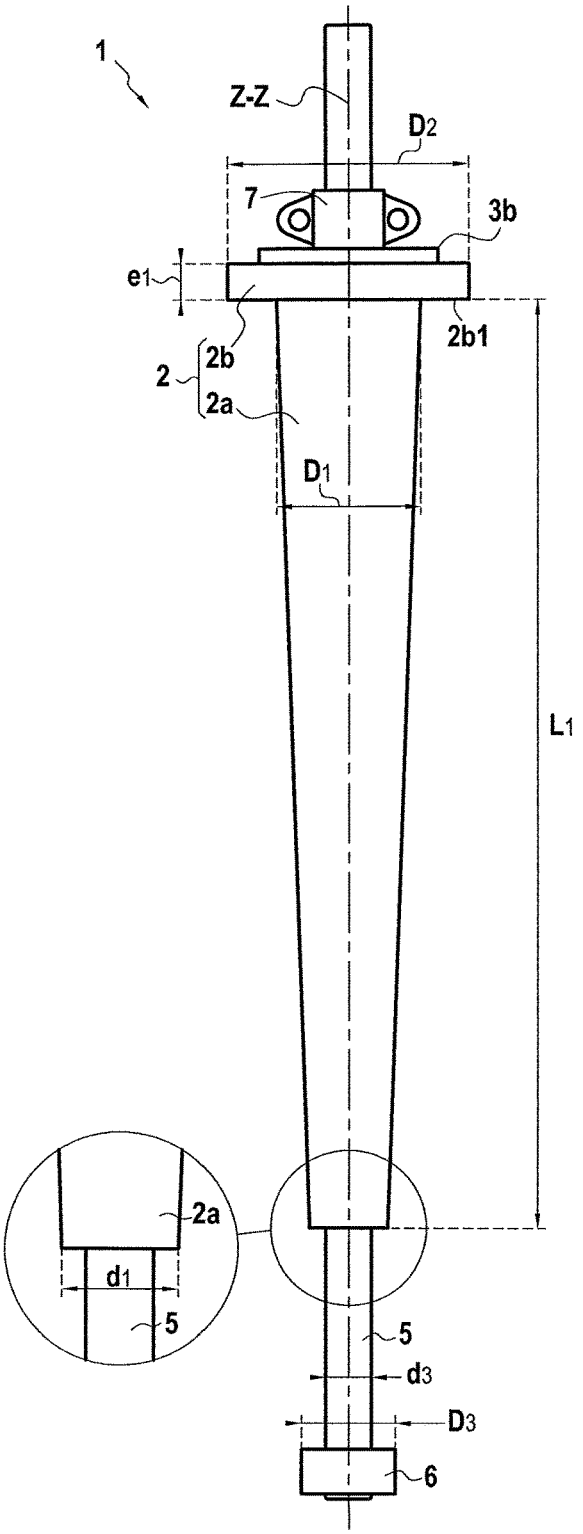

The sliding stiffener 1 as shown in the figures is constituted by a solid part made of rigid solid material such as steel, possibly reinforced by glass or synthetic fibers and comprising the following two portions: a conical main portion 2*a* and a top fastener plate 2*b*. The bottom main portion 2*a* having an outside surface in the form of a frustoconical surface of revolution extends over a length L1. It is pierced by a said first cylindrical orifice 4 of circular axis on the same axis ZZ' as the frustoconical outer surface and passing right through the main part. The diameter of the frustoconical outer surface of the main portion 2*a* varies between a maximum value D1 at its top end to a minimum value d1 at its bottom end. In the figures, the conical part is shown as having a linear generator line with diameters that vary in linear manner. Nevertheless, in another embodiment, the generator line of the surface of revolution of the current portion 2*a* could be parabolic, but in any event the diameter varies in progressive and continuous manner between the maximum value D1 and its minimum value d1.

The frustoconical main portion 2*a* is surmounted by a perforated plate forming a coaxial annular part 2*b* perforated by the top end of said first cylindrical orifice. The annular top plate 2*b* is of cylindrical shape of greatest diameter D2 that is greater than D1, and of thickness e1. The greatest diameter D2 of the annular plate 2*b* enables its underface 2*b*1 to rest on and be fastened by bolting and/or welding to the top face of a platform of a support structure 9 secured to the floating support or vessel described below with reference to FIG. 2.

In an embodiment, the main portion 2*a* of the frustoconical outer surface may be made by machining a tubular perforated part having a cylindrical outer surface of circular section, said machining enabling its thickness and thus its outside diameter to be reduced progressively in continuous manner all along its length.

The part 2 may also and preferably be made in the form of a forging having the top plate 2*b* made integrally with the bottom main portion 2*a*, said part 2 having said first axial cylindrical orifice 4 passing continuously therethrough.

In another embodiment, the annular top plate 2*b* is welded to the top end of the main portion 2*a* having the frustoconical surface.

The part 2 has a slippery coating 3 in the form of an inner jacket of plastics material, preferably of thermoplastic material, for said first orifice and referred to as a "liner". Such lining may be performed by "swagelining" as described in FR 2 876 773. To do this, the following steps are performed:

a) preparing a liner pipe 3-1 of flexible and elastic thermoplastic material inside said first orifice, said liner pipe presenting a diameter that is slightly greater than the diameter of said first orifice;

b) heating said liner pipe by passing it through a heater oven and then through a die in order to leave the die going towards said first orifice with an outside diameter that is slightly less than the inside diameter of said first orifice;

c) a first end of the liner pipe is inserted into a first end of said first orifice. Said first end of the liner pipe is fitted with a traction head connected to a winch outside said first orifice beyond its second end;

d) applying traction to the liner pipe from the second end of the orifice 4. During this traction, the liner pipe thus has its diameter diminished and also its nominal length increased. During a stage of preparing the pulling, the inside wall of said first orifice is coated with an adhesive, e.g. an adhesive of epoxy or two-component polyurethane type; and e) after said liner pipe has been pulled inside said first orifice to its second end, traction on the liner pipe is released once it has passed through the entire first orifice. Because it initially presented a diameter greater than the diameter of the first orifice, said released liner pipe then presses against the steel inside surface of the first orifice and adheres thereto by melting as a result of being heated, with adhesion possibly being reinforced by the adhesive.

Advantageously, the fastener flange 2*b* is provided on its top surface with a portion 3*b* of internal coating extending continuously with the cylindrical coating 3*a* inside said first orifice 4. This plane top portion 3*b* serves to protect the top face of the fastener flange 2*b*.

In another embodiment, the thermoplastic internal coating is pressed against the inside surface of said first orifice as an interference fit.

In order to use a steel service tube having a diameter 3.5" (89 mm) with an elastic limit of 555 MPa that is to be deployed over a length of more than 2 km in order to be installed at a depth of about 2000 m.

Use is made of a sliding stiffener presenting the following dimensional characteristics:

L1=2 m to 7 m;

e=thickness of the steel cone of stiffness varying from:

e max=10 mm to 50 mm at the top; to e min=2 mm to 3 mm at the bottom; and thickness of the polyethylene (PE) coating=5 mm to 25 mm.

The flange 2*b* connected by welding to the top of the stiffener 2*a* presents a thickness e1 greater than the maximum thickness e max of the stiffener.

Figure 1B:
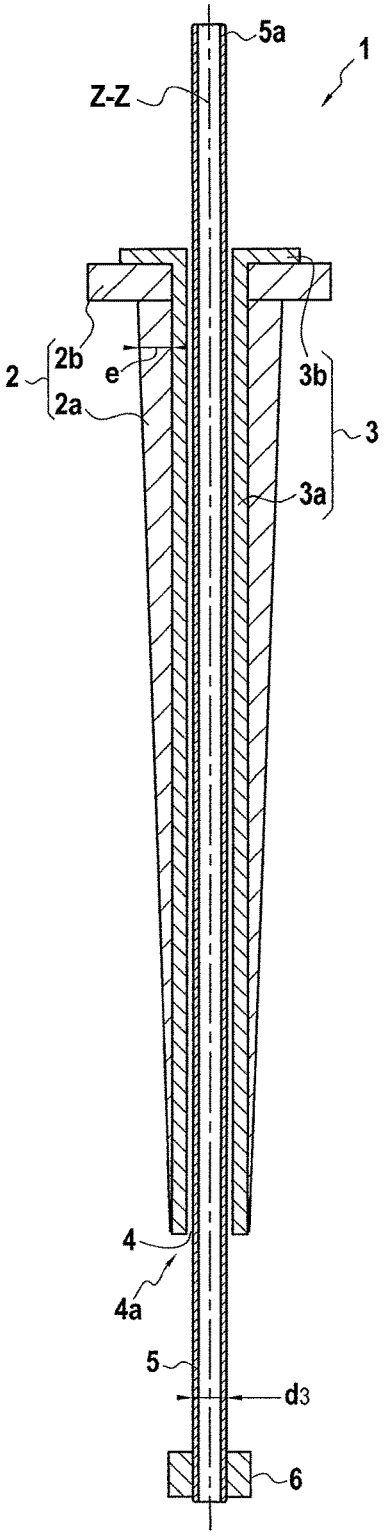

In FIGS. 1A and 1B, the sliding stiffener 1 is fitted with a connection tube 5 having the same diameter and the same thickness as the service tube with which it is to be connected at its chamfered top end 5*a*. Its bottom end is fitted with a male or female element of an automatic connector 6, once more as an interference fit or by welding. The greatest outside diameter D3 of said connector element 6 is greater than the inside diameter of said first orifice d2. The top end 5*a* of the connection tube 5 extends above the top fastener plate 2*b*.

In an embodiment, the connection tube 5 is thus held in suspension with its top end 5*a* extending above the plate 2*b* by a clamp 7 clamped around the outside surface of the connection tube and resting on the top face of the plate 2*b*.

The outside diameter of the connection tube d3 in its main portion provides minimum clearance relative to the inside diameter d2 of the first orifice coated with said internal liner 3 so as to enable the tube 5 to slide via its top end 5*a* inserted into the bottom end of the first orifice in the conical part 2.

FIGS. 2 and 3 show a complete bottom-to-surface connection installation showing how a rigid steel service tube 10 wound on a drum 12 on the deck of a floating support or vessel 13 is deployed. The steel service tube 10 is unwound and passes through a straightener device 11 and then through a device 18 for greasing and smoothing its outside surface. Thereafter, its end is welded to the top end 5*a* of the connection tube 5 that is secured to a sliding stiffener 1 having its top annular plate 2*b* fastened to the top plate 9*a* of a platform of a support structure 9, the frustoconical main portion 2*a* of the sliding stiffener passing through an orifice 8 in the platform 9 (FIG. 1C). Thereafter, the connection tube 5 is disconnected from the stiffener 1 so as to enable the connection tube 5 together with the service tube to slide and be deployed in immersion down to the sea bottom. For this purpose, the clamp or collar 7 that was holding the connection tube in suspension in the sliding stiffener as shown in FIG. 1A is disengaged.

FIG. 2 shows the service tube after unwinding and immersing the end of the steel service tube fitted with its connection tube.

In FIG. 2, the connection element 6 at the end of the connection tube 5 is connected to a complementary connection element 6' of an automatic connector at the end of a flexible pipe 15 having its other end giving access to and enabling maintenance and/or tests to be performed on undersea equipment 16 resting on the sea bottom 17, such as a well head or an undersea oil production pipe.

The equipment 16 may be connected to the bottom end of the connection tube 5 before or after separating and lowering in immersion the connection tube 5 relative to the stiffener by using an undersea robot of the ROV type.

The invention claimed is:

1. A method of installing and operating a rigid tube referred to as a main tube, the method comprising the following steps:

a) lowering an end of said main tube from a floating support or vessel on the sea surface to below sea surface level in order to be connected to undersea equipment that is immersed; and b) maintaining the main tube as immersed with the lower end of the main tube suspended below the sea surface for a given period of time;

wherein said main tube is passed through a cylindrical orifice of circular section referred to as a first orifice, in a stress limiter device referred to as a sliding stiffener, said first orifice having an internal lubricating coating, said sliding stiffener being secured to a support structure, said support structure secured to said floating support or vessel and extending outside said floating support or vessel over the sea surface, a top portion of said main tube being held in suspension above said sliding stiffener, such that said main tube is suitable for sliding in contact against said lubricating coating during steps a) and b).

2. The method according to claim 1, wherein said sliding stiffener comprises a solid rigid part having said first orifice having a vertical axis (ZZ') passing through its material, said rigid part comprising a main portion presenting an outside surface of revolution about the axis of said first orifice of diameter that decreases progressively and continuously going down said sliding stiffener to the bottom end of said sliding stiffener.

3. The method according to claim 2, wherein at said main portion of the rigid part constituting said sliding stiffener presents an outside surface of frustoconical shape extending from and below a top portion of said rigid part defining a fastener flange around the top end of said first orifice.

4. The method according to claim 3, wherein said fastener flange forms a fastener plate fastened to or formed integrally with the top end of said main portion, said fastener plate resting on and being fastened to a horizontal platform of said support structure, said fastener plate extending on a plane surface on top of said platform of dimension D2 that is greater than the dimension D1 of the greatest section of said main portion, said plane plate surface being of circular circumference coaxial with the circumference of said first orifice.

5. The method according to claim 1, wherein said first orifice of said sliding stiffener is covered on its surface which is in contact with said main tube by a material comprising said internal lubricating coating constituted by a solid material in the form of a plastics film layer, made of a thermoplastic or of an elastomer material, said plastics coating being further coated on its surface in contact with said main tube with a low friction anti-abrasion material selected from an oil and a grease.

6. The method according to claim 1, wherein said main tube is coated in a low friction anti-abrasion material selected from an oil and a grease, and wherein the treatment for performing said coating is performed after step a) and before inserting the main tube in said first orifice.

7. The method according to claim 1, wherein said sliding stiffener is pre-fitted with a tube portion referred to as a connection tube that is fastened and/or suspended in reversible manner to said support structure and/or to said sliding stiffener, said connection tube being engaged in said first orifice and having a connection element at its bottom end beneath said stiffener, the connection element being connected or suitable for being connected to a piece of equipment and prior to step a), the following steps are performed:

connecting the end of said main tube to the top end of said connection tube;

separating said connection tube from said sliding stiffener device; and beginning the descent by descending said connection tube.

8. The method according to claim 7, wherein said connection tube includes a removable clamping collar around a portion of said connection tube projecting above said first orifice.

9. The method according to claim 1, step a), the following steps are performed:

a.1) unwinding said main tube wound on a winding support on said floating support or said vessel, and passing said main tube through a device for tensioning and reducing residual curvature associated with winding and then through a grease box and a trimming collar, prior to inserting it in said sliding stiffener; and a.2) lowering said main tube below sea level by causing it to slide through said sliding stiffener.

10. The method according to claim 1, wherein in step b), said main tube unwound from a floating support or a vessel at the sea surface down to the sea bottom passing through a said sliding stiffener is maintained and stabilized after said descent and implementation for a period of at least 24 hours before raising it to the sea surface and/or without unwinding any additional length.

11. The method according to claim 1, wherein an undersea pipe and/or a wellbore at the sea bottom is verified and/or maintained by sending a liquid or a gas via said main tube having its bottom end connected to said undersea pipe and/or a wellbore at the sea bottom.

12. An installation suitable for performing a method according to claim 1, the installation comprises a support structure secured to a floating support or vessel on the sea surface, the support structure having fastened thereto a sliding stiffener comprising a solid rigid part having an outside surface of revolution of diameter that decreases progressively and continuously going down said sliding stiffener to the bottom end of said stiffener having an axial orifice referred to as a "first orifice" with an internal lubricating coating, said internal coating being suitable for enabling sliding of a main tube inserted into said first orifice in contact with said main tube.

13. The installation according to claim 12, wherein said first orifice of said rigid stiffener part is covered on its surface in contact with said main tube by a material comprising said internal lubricating coating constituted by a solid coating of a layer of plastics film made of a thermoplastic material or of an elastomer, said layer of plastics film being further coated on its surface in contact with said main tube with a low friction anti-abrasion material selected from an oil and a grease.

14. The installation according to claim 12, wherein said sliding stiffener is fitted with a tube portion referred to as a connection tube that is reversibly fastened to said sliding stiffener, said connection tube having the same diameter as said main tube, said connection tube being engaged in said first orifice and having at its bottom end, below said stiffener, said connection element that is connected to or suitable for being connected to a piece of equipment or a flexible or semi-rigid pipe.

15. The installation according to claim 14, wherein said connection tube includes a removable clamping collar around a portion of said connection tube projecting above said first orifice.

* * * * *